United States Patent [19]

Burchett

[11] Patent Number: 4,993,579

[45] Date of Patent: Feb. 19, 1991

[54] BLADDER TYPE CONTAINER FOR TOXIC MATERIALS

[75] Inventor: Dennis M. Burchett, Greeley, Colo.

[73] Assignee: Platte Chemical Co., Freemont, Nebr.

[21] Appl. No.: 499,180

[22] Filed: Mar. 26, 1990

[51] Int. Cl.[5] ..... B65D 85/00

[52] U.S. Cl. ..... 220/403; 220/404; 220/470

[58] Field of Search ..... 220/404, 403, 410, 411, 220/470

[56] References Cited

U.S. PATENT DOCUMENTS

| | | | |
|---|---|---|---|
| 2,338,604 | 1/1944 | Silveyra . | |
| 2,794,570 | 6/1957 | Downs . | |
| 3,082,927 | 7/1960 | Winstead . | |
| 3,198,390 | 8/1965 | Beckman et al. . | |
| 3,453,033 | 7/1969 | Goss . | |
| 3,834,570 | 9/1974 | Barr . | |
| 4,321,922 | 3/1982 | Deaton | 220/404 |
| 4,330,066 | 5/1982 | Berliner | 220/404 |
| 4,459,793 | 7/1984 | Zenger | 220/404 |
| 4,461,402 | 7/1984 | Fell . | |
| 4,516,692 | 5/1985 | Croley . | |
| 4,560,085 | 12/1985 | Vom Hofe et al. . | |
| 4,586,628 | 5/1986 | Nittel . | |
| 4,623,075 | 11/1986 | Riley | 220/407 |
| 4,635,814 | 1/1987 | Jones . | |
| 4,658,989 | 4/1987 | Bonerb . | |
| 4,805,799 | 2/1989 | Robbins, III . | |

*Primary Examiner*—Joseph Man-Fu Moy

*Attorney, Agent, or Firm*—Willian Brinks Olds Hofer Gilson & Lione

[57] ABSTRACT

A container for controlling exposure to material stored in the container includes a substantially rigid enclosure that defines a central cavity and a set of openings including at least a first opening extending between the central cavity and a region exterior of the enclosure. The central cavity communicates with the region exterior of the enclosure only via the set of openings. A bladder is disposed in the central cavity and has a neck releasably secured in the enclosure at the first opening. The bladder receives a material to be stored and discharged only via the bladder neck. A tether is releasably secured between the bladder and the enclosure at the bottom of the cavity to prevent the bladder from moving toward the first opening and obstructing material flow through the neck. Caps seal the bladder and the enclosure opening to form a double sealed container.

40 Claims, 5 Drawing Sheets

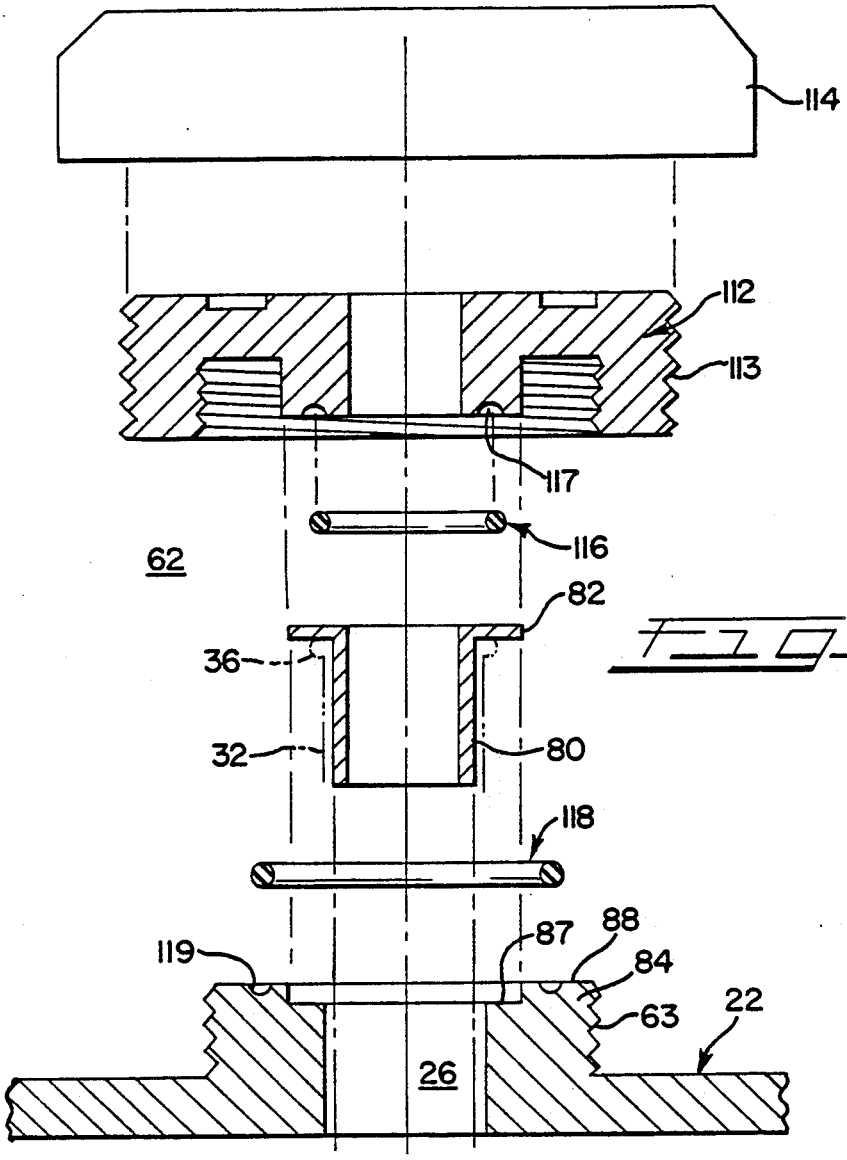
FIG. 4
FIG. 5
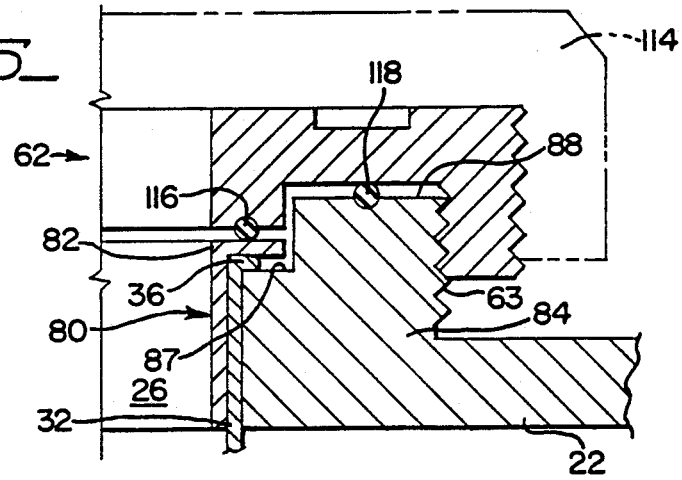

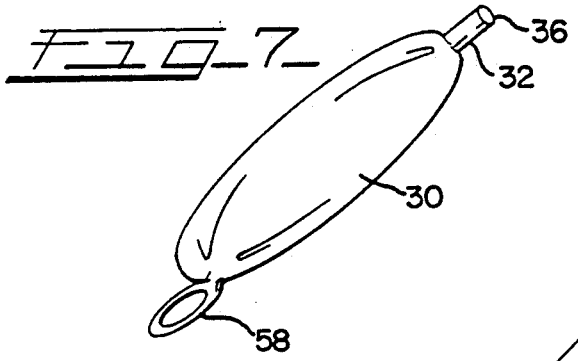
FIG. 7
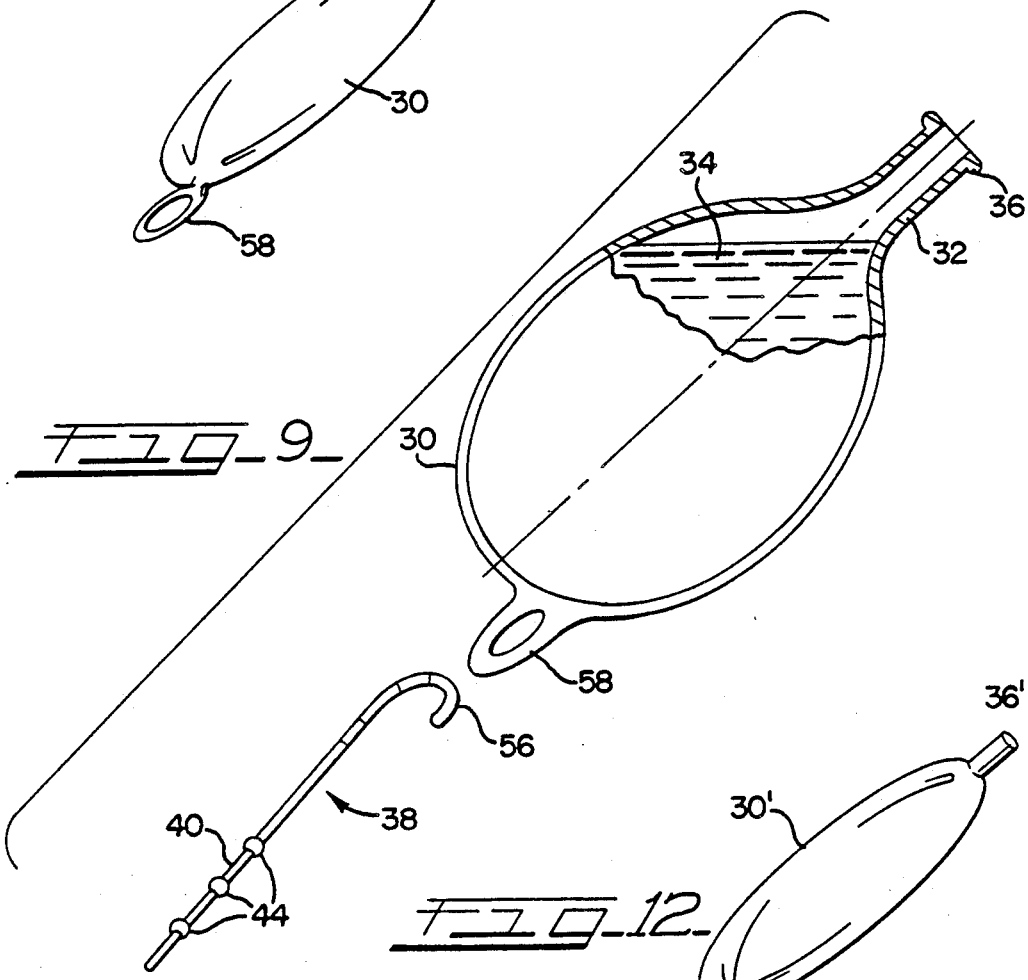
FIG. 9
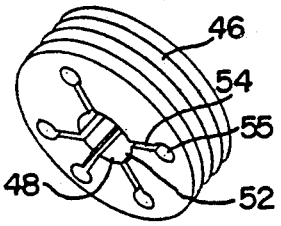
FIG. 8
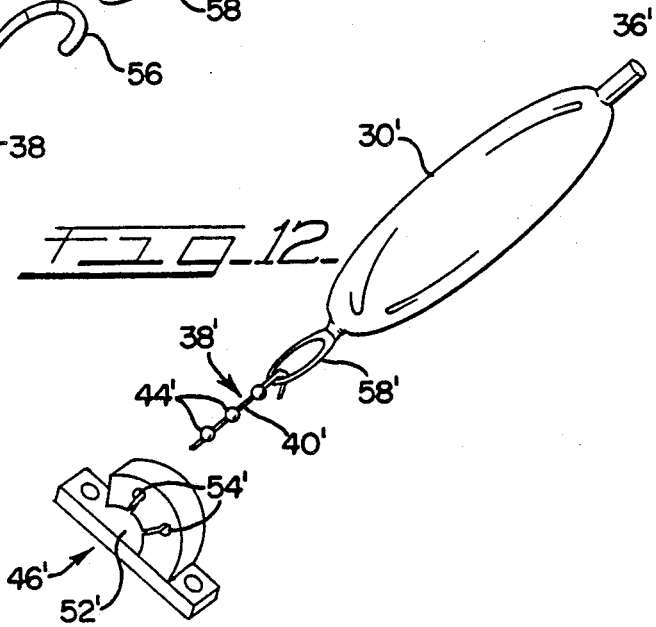
FIG. 12
FIG. 13

BLADDER TYPE CONTAINER FOR TOXIC MATERIALS

TECHNICAL FIELD

The present invention is directed to a bladder type container, and more particularly to a bladder type toxic materials, and components thereof.

BACKGROUND OF THE INVENTION

Considerable work has been done in the field of rigid containers having removable bladder-type linings. Typically, such linings include both one and two spout linings, and linings replaced through a container opening are known in the art.

Beckman U.S. Pat. No. 3,198,390 discloses a milk container having an outer rigid housing and a replaceable inner bladder, where the single neck bladder is replaced via the spout opening in the housing without disassembly of the housing. The opposite end of the bladder is not attached to the housing cavity to prevent the bladder from collapsing and blocking the spout.

Bonerb U.S. Pat. No. 4,658,989 discloses a disposable, flexible liner having upper and lower necks which pass through respective openings in an outer rigid container, and pressure sensitive adhesive spots to cause the lining to adhere to the container. However, Bonerb does not show any particular spout assembly to secure the necks of the bladder to the container.

Barr U.S. Pat. No. 3,834,570 Goss U.S. Pat. No. 3,453,033, Robbins U.S. Pat. No. 4,805,799, Silveyra U.S. Pat. No. 2,338,604, Croley U.S. Pat. No. 4,516,692, Vom Hofe U.S. Pat. No. 4,560,085, and Instead U.S. Pat. No. 3,082,924 all disclose container systems using an outer rigid container and an inner bladder having a single neck used to dispense liquids from the container.

Jones U.S. Pat. No. 4,635,814 discloses a lined drum having a pair of spouts included in a bladder. However, it is clear that the container must be disassembled to remove and replace the bladder. The same appears to be true for the lined tank shown in Downs U.S. Pat. No. 2,794,570. Fell U.S. Pat. No. 4,461,402 and Nittel U.S. Pat. No. 4,586,028 also show rigid containers with removable bladders having two openings. However, it appears that in Fell the bladder is not inserted into the housing via a spout opening, and in Nittel the bladder has only a single spout secured to the container.

The background art does not describe a substantially rigid, single opening container having a bladder, where the bladder neck is secured to the opening and the other end of the bladder is secured to the inside of the container cavity at a point spaced from the opening. This prevents the bladder from collapsing on itself and clogging material flow from the opening. Further, the bladder is replaceable via the opening without disassembly of the container.

Still further, the art does not describe a substantially rigid, two opening container having a bladder where the neck of the bladder is secured to the one opening and where the bladder is replaceable via one of the openings without disassembly of the container.

SUMMARY OF THE INVENTION

Accordingly, it is a principal object of the present invention to provide an improved bladder type container for handling toxic materials.

It is a further object of the invention to provide a container having a substantially rigid enclosure that defines a central cavity.

It is a still further object of this invention to provide a bladder for insertion in a container having a substantially rigid enclosure.

Another object of this invention is to provide a method for installing a bladder in a container for handling toxic materials.

Another object of this invention is to provide a double sealed container having a bladder disposed in a cavity in a container which continues to provide sealed protection even if the bladder is ruptured.

Still another object of this invention is to provide a method of using a double sealed container to control exposure to toxic materials stored within the container.

According to this invention, a container is provided comprising a substantially rigid enclosure that defines a central cavity and a set of openings including at least a first opening extending between the central cavity and a region exterior of the enclosure. The central cavity communicates with the region exterior of the enclosure only via the set of openings. A bladder is disposed in the central cavity and has a neck releasably secured to the enclosure at the first opening and receives material to be stored and discharged only via the neck. The bladder is prevented from moving toward the first opening and obstructing material flow through the neck by a tether releasably secured between the bladder and the enclosure to an anchor positioned within the cavity at a point spaced from the first opening. The bladder is configured and adapted to be inserted into and removed from the central cavity via an opening included in the set of openings, without disassembly of the enclosure.

Preferably, the enclosure includes a second opening, and the bladder is releasably secured to the enclosure at both the first and second openings. The bladder includes a tether which passes through the second opening and is secured to the enclosure at the second opening.

A double sealed container additionally comprises a first cap means which includes a bladder cap for releasably sealing the bladder and a first enclosure cap for releasably sealing the first opening to the enclosure. The bladder cap may include a frangible membrane to provide ready access for pouring the material from the bladder. The bladder and the bladder cap form a first sealed system, and the enclosure and first enclosure cap form a second sealed system effective to prevent spillage in the event of a failure of the bladder or the membrane.

Preferably, a method for installing a bladder in an enclosure comprises the following steps. A substantially rigid enclosure is provided that defines a central cavity and a set of openings including at least a first opening extending between the central cavity and a region exterior of the enclosure. The central cavity communicates with the region exterior of the enclosure only via the set of openings. A bladder is provided that includes a neck and the bladder is passed through an opening into the central cavity and releasably secured to the enclosure at a point spaced from the first opening. The bladder neck is releasably secured to the enclosure at the first opening and the first opening is releasably sealed to seal the enclosure around the bladder.

Once the bladder is filled with material, a bladder cap including a frangible membrane may be used to releasably seal the first opening and the neck to form a first sealed system with the bladder. A first enclosure cap may be secured over the bladder cap on the enclosure to form a second sealed system effective to prevent spillage of the material in the event of a failure of the bladder.

As pointed out in greater detail below, the bladder type container of this invention provides important advantages. Toxic materials may be safely stored, handled and used, and the disclosed container may be easily stacked with similar containers. The bladder is releasably secured to allow material to be poured from the container in a safe and controlled manner, and the bladder may be safely disposed of after use. The container enclosure is reusable simply by inserting a new bladder and releasably securing the new bladder as taught by this invention. The double sealed feature ensures that material is confined in the container even in the event of a bladder rupture. The container is of rugged construction and the bladder can withstand sudden decelerations.

The invention itself, together with further objects and attendant advantages, will best be understood by reference to the following detailed description, taken in conjunction with the accompanying drawings.

BRIEF DESCRIPTION OF THE DRAWINGS

FIG. 4 is an exploded cross-sectional view of one embodiment of first cap means for sealing the first enclosure opening of FIG. 1.

FIG. 5 is a cross-sectional view of one side of the assembled first cap means of FIG. 4.

FIG. 7 is a perspective view of a bladder included in the container of FIG. 1.

FIG. 8 is a perspective view of the anchor of FIG. 6.

FIG. 9 is a fragmentary perspective view of the bladder of FIG. 7 and a tether.

FIG. 12 is a perspective view of a second embodiment of a bladder with integral tether.

FIG. 13 is a perspective view of a second embodiment of an anchor.

BEST MODE FOR CARRYING OUT THE INVENTION

Figure 1:
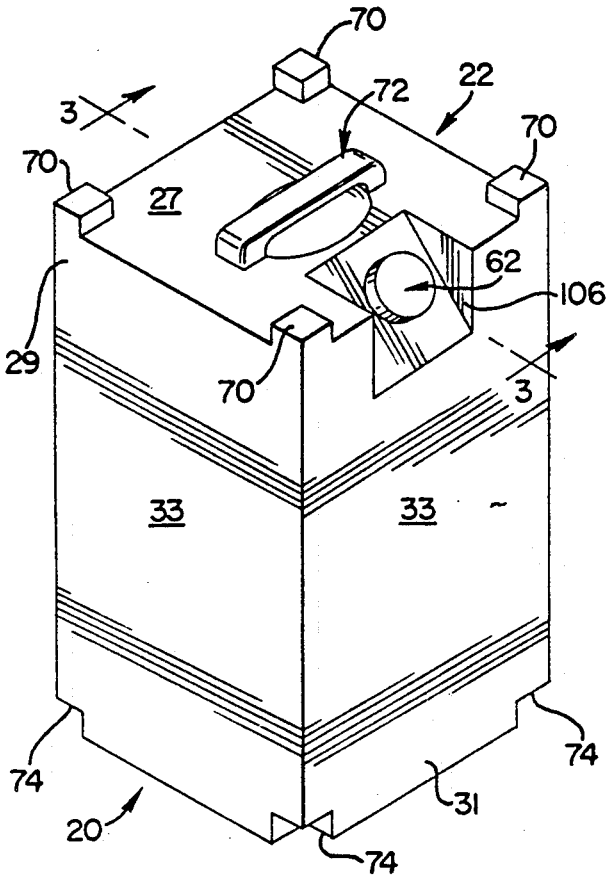
FIG. 1 is a perspective view of a first embodiment of a container of this invention.

FIGS. 1 through 9 relate to a first preferred embodiment 20 of the container of this invention. This container 20 includes a substantially rigid enclosure 22 which receives a flexible bladder 30. The following detailed description will take up first the enclosure 22, and then the bladder 30 and the means for mounting the bladder 30 in place and sealing the bladder 30 and the container 22.

Figure 3:
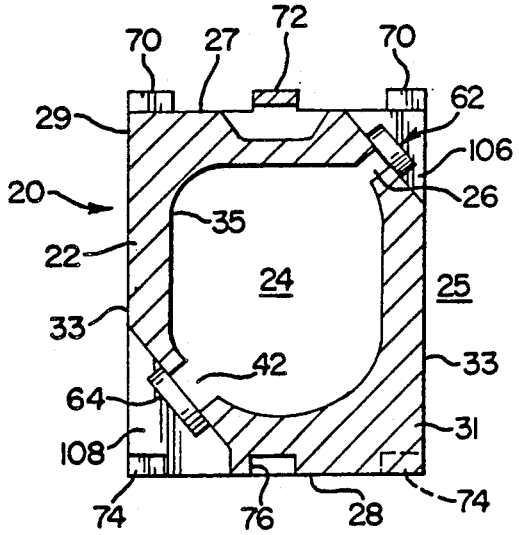
FIG. 3 is a cross-sectional view taken along line 3—3 of FIG. 1.
Figure 2:
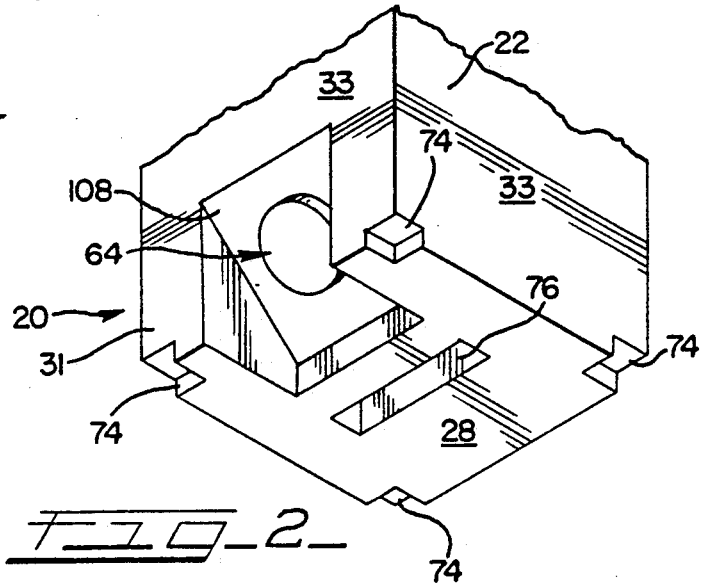
FIG. 2 is a fragmentary perspective view of the bottom portion of the container of FIG. 1.

Turning to FIGS. 1–3, the enclosure 22 defines a central cavity 24 and a set of openings, including first and second openings 26, 42 extending between the central cavity 24 and a region 25 exterior of the enclosure 22. The central cavity 24 communicates with the region 25 exterior of the enclosure 22 only via the first and second openings 26, 42. The term "set of openings" is intended to encompass one or more openings in the enclosure 22. A suitable material for the enclosure 22 is a high impact plastic such as high density polyethylene which is non-reactive to toxic substances such as pesticides or other chemicals. The enclosure 22 defines rectangular, substantially planar top and bottom surfaces 27 and 28 along the top and bottom portions 29 and 31, respectively.

As shown in FIGS. 1–2, the enclosure 22 defines four rectangular side surfaces 33. The four side surfaces 33 are nearly adjacent to the top and bottom surfaces 27, 28. The term "nearly adjacent" is intended to include rounded corners formed by the side surfaces, or the like for ease of container fabrication, shipping and storage. The enclosure 22 may include only three side surfaces, each nearly adjacent to two other side surfaces.

As shown in FIG. 3, first and second recesses 106, 108 are formed in the top and bottom portions 29, 31 at an angle acute to the top and bottom surfaces 27, 28, respectively. The first and second recesses 106, 108 are positioned to receive the first and second cap means 62, 64 described below, and to prevent the first and second cap means 62, 64 from protruding from the enclosure 22. The enclosure 22 also defines a raised handle 72 on one end and a recess 76 on the other end shaped and positioned to receive a handle of a second, similarly shaped enclosure when stacked thereon. Protrusions 70 are also defined on the top surface 27 and mating recesses 74 on the bottom surface 28 to brace the enclosure 22 when stacked with other similar enclosures.

Figure 6:
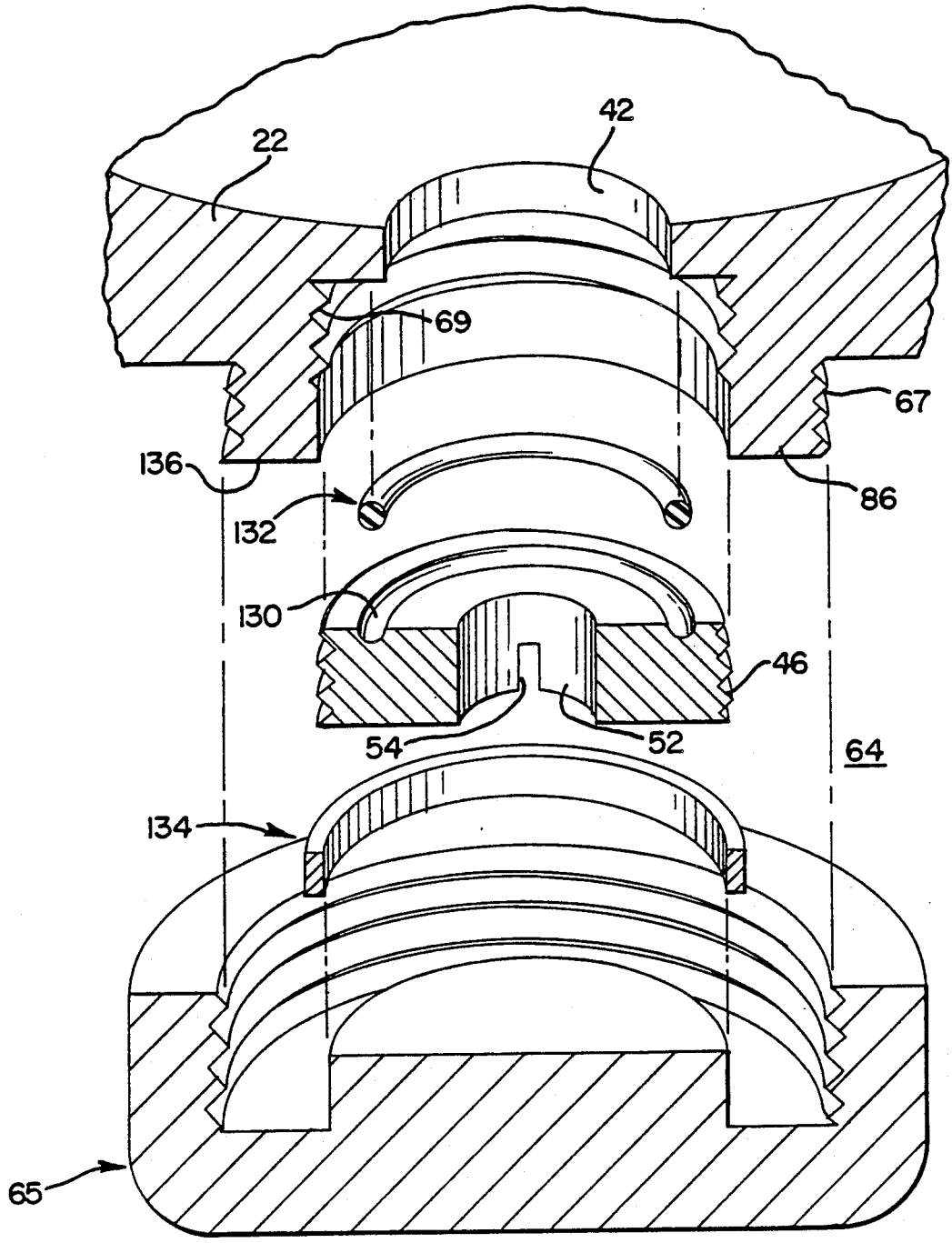
FIG. 6 is an exploded cross-sectional perspective view of a second cap means for sealing the second opening of FIG. 3.

Turning to FIGS. 4, 5 and 6, the first and second cap means 62, 64 are threadedly secured to the enclosure 22 at the first and second openings 26, 42, respectively. The enclosure 22 defines threaded bosses 84, 86 around the openings 26, 42 and internal threads 69 within opening 42. The bosses 84, 86 are provided with threads 63, 67 respectively. Further, as shown in FIG. 5, the boss 84 defines a pair of annular sealing surfaces 87, 88 around the opening 26.

Turning now to FIGS. 5, 7 and 9, a bladder 30 is disposed in the central cavity 24 and includes at least one neck 32 which is releasably secured to the enclosure 22 at the first opening 26. The bladder 30 receives a material 34 to be stored and discharged only via the bladder neck 32, which has an annular flange 36 formed about the neck 32 for sealing purposes. The rigidity of the bladder 30 may range from flexible to semi-rigid, and it is preferably fabricated from a material that is inert, non-reactive and resistant to toxic materials.

The bladder 30 is generally ovoid or egg shaped. It is expandable when filled with a material 34 to be nearly adjacent to the walls 35 of the cavity 24, or may be form fitted to fit within the walls 35. The nearness of the bladder 30 to the walls 35 creates a rugged structure which enables the container 20 to withstand sudden decelerations, such as jolts or impacts from traffic accidents. The bladder 30 may be constructed of an elastic material, such as rubber or the like or other toxic resistant, nonreactive flexible plastic material. The maximum volume of the bladder 30 may be selected as desired at one gallon, five gallons, or more.

As shown in FIGS. 8 and 9, a tether 38 is used to releasably secure the bladder 30 to the enclosure 22 at a point within the cavity 24 and spaced apart from the first opening 26. The tether 38 secures the lower portion of bladder 30 to the enclosure 22, and is positioned to prevent the bladder 30 from moving toward the first opening 26 and obstructing flow through the bladder neck 32. Absent the tether 38, the bladder 30 may under some circumstances collapse upon itself as material 34 is being poured out of the neck 32.

A bladder tether ring 58 on the bladder 30 is shaped to releasably mechanically interlock with a hook 56 on the tether 38. The tether 38 also includes a tether cord 40 which defines a plurality of beads or projections 44 spaced along the tether cord 40. The tether cord 40 is releasably secured to the enclosure 22 via an anchor 46 positioned in the opening 42 at a point spaced from the first opening 26. As shown in FIG. 8, the anchor 46 defines an opening 48 having a larger region 52 sized large enough to allow the tether cord 40 to pass therethrough, and a number of smaller regions 54 sized to allow the tether cord 40 but not the beads 44 to pass therethrough. Preferably, the smaller regions 54 are shaped as slots which terminate in depressions 55 sized to partially receive one of the beads 44 to hold the tether cord 40 in place.

As shown in FIGS. 4 and 5, the bladder neck 32 is mounted to the enclosure 22 by means of a sleeve 80 sized to fit within the bladder neck 32 to bring a sleeve flange 82 adjacent to the bladder neck flange 36. A threaded annulus 112 is threaded onto the boss 84 around the first opening 26 to releasably clamp the sleeve flange 82 and the bladder neck flange 36 against the sealing surface 87. Suitable sealing rings, such as O-rings 116 and 118, are placed in recesses 117 and 119 between annulus 112 and flange 82 and sealing surface 89, respectively.

The first cap means 62 further comprises a threaded cap 114 removably mounted to exterior threads 113 of the threaded annulus 112 around the first opening 26 to releasably seal the first opening 26 and the bladder neck 32. A suitable cap may be obtained from Rieke Corp. of Auburn, Ind., and may if desired have a retractable spout.

Turning to FIG. 6, the anchor 46 is mounted to the enclosure 22 in the second opening 42 via the internal threads 69. The anchor 46 has a recess 130 to accept an O-ring 132 to form a seal with the enclosure 22, and a sealing ring 134 is positioned between a second cap 65 included in the cap means 64 and a planar surface 136 defined around the second opening 42. The second cap 65 is threaded to the threads 67, and the rings 132 and 134 deform to assure sealing integrity.

The container 20 is preferably assembled as follows. First the threaded cap 114, the threaded annulus 112, the cap 65 and the anchor 46 are removed, and then the bladder 30 is introduced into the central cavity 24 via the second opening 42. Once the bladder 30 is generally in position with the neck 32 positioned as shown in FIG. 4, the sleeve 80 is inserted in the neck 32 of the bladder 30, the O-rings 116, 118 are installed, and the annulus 112 is threaded onto the boss 84 to clamp the sleeve 80 and the neck 32 in place. The O-rings 116, 118 prevent any leakage between the annulus 112 and the boss 84.

Then the tether 38 is mechanically engaged with the bladder 30 via the hook 56 and the ring 58. Once the tether 38 has been engaged with the bladder 30 and the anchor 46 has been replaced in the second opening 42, the tether cord 40 is then pulled to tension the bladder 30 to hold it in position. Once a proper degree of tension has been achieved, the tether cord 40 is then moved into one of the smaller regions 54 defined by the anchor 46. An appropriate one of the beads 44 comes to rest in one of the depressions 55 in order to hold the tether 38 in tension. At this point, the tether cord 40 can be severed adjacent the engaged one of the beads 44, and the second cap 65 can be threaded onto the boss 86. The O-ring 132 provides a liquid tight seal between the enclosure 22 and the anchor 46, and the ring 134 provides a liquid tight seal between the cap 65 and the enclosure 22. The cap 65 bears on the severed end of the tether cord 40 to prevent the tether cord 40 from moving out of the smaller region 54 of the anchor 46.

Once the container 20 is fully assembled, it provides two sealed systems, which must both fail before any material contained in the bladder 30 can pass out of the container 20. The first sealed system is made up of the bladder 30, the annulus 112 and the cap 114. This is the primary system used to retain the material in the bladder 30. However, in the event of a failure of the bladder 30, materials are still retained within the enclosure 22, which is sealed by the cap means 64, the annulus 112 and the cap 114. This double sealed system provides fail-safe protection against spillage.

Figures 10, 11:
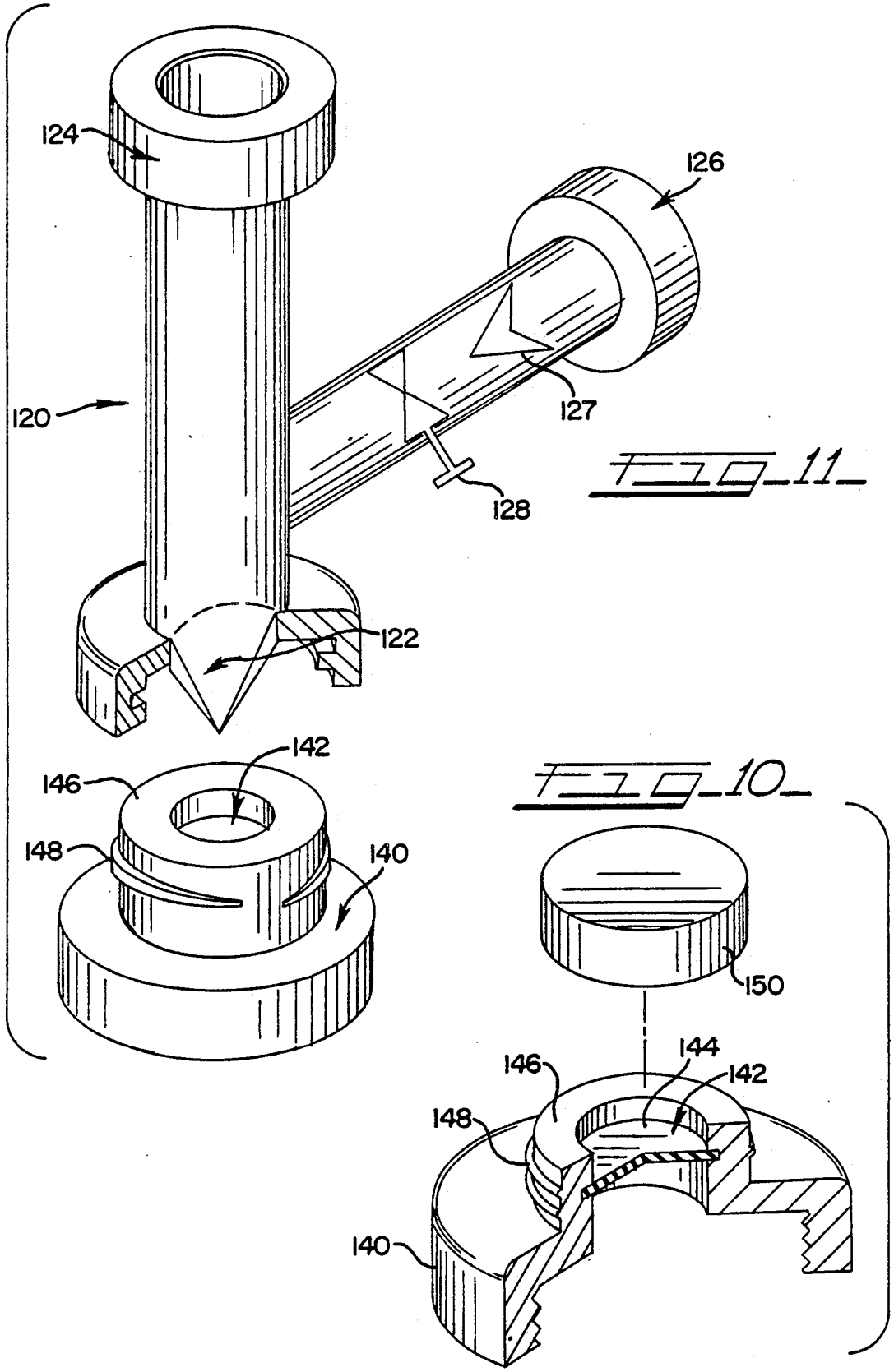
FIG. 10 is an exploded fragmentary cross-sectional view of an alternate means for sealing the first enclosure opening of FIG. 1.
FIG. 11 is a fragmentary perspective view of a pour and purge device suitable for use with the sealing means of FIG. 11.

Of course, many changes and modifications can be made to the container 20. For example, as shown in FIG. 10, the cap 114 may be replaced with a two part cap suitable for use in a closed system. Such a two part cap includes a bladder cap 140 which defines a central opening 142 sealed by a frangible membrane 144. The central opening 142 is surrounded by a raised boss 146 provided with external threads 148. An enclosure cap 150 is provided which is shaped to engage the threads 148 to seal the central opening 142 after the membrane 144 has been pierced, and to protect the membrane 144 before it is pierced. The bladder cap 140 seals the bladder 30, and the enclosure cap 150 seals the enclosure 22. Thus, the caps 140, 150 provide a double sealed system similar to that described above in conjunction with the cap 114. A double sealed system is particularly suitable for controlling toxic substances.

The arrangement shown in FIG. 10 can be used with a pour and purge device 120 as shown in FIG. 11. This pour and purge device includes a membrane piercing blade 122 and a pouring spout 124. Once the pour and purge device 120 has been screwed onto the threads 148, material inside the bladder 30 can be discharged out the pouring spout 124.

The pour and purge device 120 also includes a purge connection 126 which communicates with the pouring spout 124 via a one-way valve 127 and a flow control valve 128. After the bladder 30 has been emptied, the purge connection 126 can be connected to a source of a purging liquid such as water, and then the valve 128 opened to introduce purging liquid into the bladder 30. Once the bladder 30 has been completely rinsed, the valve 128 can be closed and the purging liquid discharged from the bladder 30 via the pouring spout 124. It should be noted that the central cavity 24 is provided without protrusions or ledges that might trap any substantial part of the material in the bladder 30 and thereby prevent complete emptying of the bladder 30. Furthermore, the tether 38 operates as described above to prevent the bladder 30 from folding onto itself and preventing complete emptying of the bladder 30. These features of the container 20 minimize material left in the bladder 30 once it is emptied and removed for disposal.

Once the bladder 30 is emptied, the container 20 can easily be reused. First the cap means 64 is removed and the tether cord 40 is released from the anchor 46. Then the cap 114 or 140 is removed along with the annulus 112 and the sleeve 80. The bladder 30 can be removed via the second opening 42 for disposal, and it can be replaced as described above with another bladder to allow reuse of the enclosure 22 and other components.

Other possible variations on the container 20 include alternatives (not shown) which include only a single opening in the enclosure 22. For example, the enclosure may define a central cavity 24 which communicates with the region 25 exterior of the enclosure only via the first opening 26. A bladder 30 having a neck 32 is passed through the first opening 26 into the central cavity 24 and is releasably secured to the enclosure 22 at a point spaced from the first opening 26. The bladder neck 32 is releasably secured to the enclosure 22 at the first opening 26 and the first opening 26 is then releasably sealed to seal the enclosure 22 around the bladder 30. In this embodiment, the opening 26 would be sufficiently large to allow a user's hand to fit within the cavity 24 to secure the bladder 30 to a tether, which in this embodiment would be fixed to the wall 35 of the cavity 24.

In another variation as shown in FIG. 12 a bladder 30' includes a tether 38' formed integrally on the bladder 30'. In this embodiment, the tether 38' includes a tether cord 40' extending from a protrusion 58' on the bladder 30'.

The bladder 30' can be used for example with an enclosure having only a single opening 26, as described above. With this approach, an anchor 46' (FIG. 13) can be secured to a wall of the central cavity. The anchor 46' is similar to the anchor 46 in that it defines a larger region 52' sized to pass the tether cord 40' and a number of smaller regions 54' sized to engage beads 44' on the tether cord 40' to L hold the tether cord 40' in the desired position.

The embodiments described above provide a number of significant advantages. The substantially rigid enclosure 22 allows toxic materials to be safely stored, handled and used. The container 20 may easily be stacked with similar containers with little risk to damaging the first and second enclosure cap means 62, 64. The cavity 24 is smoothly formed within the enclosure 22 to allow the bladder 30 to bear against, or nearly bear against, the cavity walls. This forms a rugged, double sealed container 20 which reduces the risk of bladder damage from sudden impacts.

As yet another advantage, the bladder 30 is secured so that it will not collapse upon itself when in the pouring position. It may be safely disposed of after use. The container enclosure 22 is reusable by simply inserting a new bladder 30 and releasably securing the bladder in the enclosure 22. The frangible membrane cap allows the container to be used in a closed system, and the enclosure cavity to be cleaned by remote flushing without human contact with the cavity.

Of course, it should be understood that a wide range of changes and modifications can be made to the preferred embodiments described above. For example, the caps may be designed as crimp-on caps rather than the screw-on caps described above. Additionally, sizes, shapes and materials may all be varied as appropriate for specific applications. It is therefore intended that the foregoing detailed description be regarded as illustrative rather than limiting, and that it be understood that it is the following claims, including all equivalents, which are intended to define the scope of this invention.

What is claimed is:

1. A container comprising:

a substantially rigid enclosure that defines a central cavity and a set of openings including at least a first opening extending between the central cavity and a region exterior of the enclosure, said central cavity communicating with the region exterior of the enclosure only via the set of openings;

a bladder disposed in the central cavity and having a neck releasably secured to the enclosure at the first opening, said bladder receiving a material to be stored and discharging same only via the neck; and a tether releasably secured between the bladder and the enclosure at a point spaced from the first opening, said tether positioned to prevent the bladder from moving toward the first opening and obstructing flow through the neck;

said bladder configured and adapted to be inserted into and removed from the central cavity via an opening included in the set of openings, without disassembly of the enclosure.

2. The invention of claim 1 wherein the set of openings additionally comprises a second opening and the central cavity communicates with the region exterior the enclosure only via the first and second openings.

3. The invention of claim 1, wherein the tether defines a hook on one end thereof, and wherein the bladder is shaped to releasably mechanically interlock with the hook.

4. The invention of claim 2 further comprising first and second caps removably secured to the enclosure at the first and second openings to seal the first and second openings, respectively.

5. The invention of claim 4 wherein the caps are threadedly secured to the enclosure.

6. The invention of claim 2 wherein the tether defines a plurality of beads spaced along the tether, and wherein the tether is releasably secured to the enclosure by a mounting anchor positioned in the second opening and defining at least one slot having a larger region large enough to allow the tether and the beads to pass therethrough, and a smaller region large enough to allow the tether but not the beads to pass therethrough.

7. The invention of claim 1 wherein the enclosure defines protrusions on one exterior surface and mating recesses on an opposite exterior surface to brace the enclosure when stacked with another similar enclosure.

8. A method for installing a bladder in an enclosure comprising the following steps:

(a) providing a substantially rigid enclosure that defines a central cavity and a set of openings including at least a first opening extending between the central cavity and a region exterior of the enclosure, said central cavity communicating with the region exterior of the enclosure only via the set of openings;

(b) providing a bladder having a neck;

(c) passing the bladder through an opening included in the set of openings into the central cavity;

(d) releasably securing the bladder to the enclosure at a point spaced from the first opening;

(e) releasably securing the neck to the enclosure at the first opening; and (f) releasably sealing all of the openings in the set of openings to seal the enclosure around the bladder.

9. The invention of claim 8 wherein the set of openings comprises the first opening and an additional second opening, and wherein the bladder is releasably secured to the enclosure at the second opening in step (d).

10. The invention of claim 9 wherein the bladder is secured to a tether, and wherein step (c) comprises the step of pulling the tether through the second opening and securing the tether to the enclosure at the second opening.

11. The invention of claim 8 wherein step (e) comprises the following steps:

positioning a tube within the neck, said tube defining a tube flange; and securing the tube in the first opening with the neck clamped between the tube and the enclosure.

12. The invention of claim 11 wherein the neck defines an annular flange, and the tube securing step comprises the step of clamping the neck flange between the tube flange and the enclosure.

13. A double sealed container comprising:

a substantially rigid enclosure that defines a central cavity and a set of openings including first and second openings extending between the central cavity and a region exterior of the enclosure, said central cavity communicating with the region exterior of the enclosure only via the set of openings;

a bladder disposed in the central cavity and having a neck, said bladder defining an interior that communicates with the region exterior of the enclosure only via the neck, said bladder configured to be installed into and removed from the central cavity via at least one of the openings without disassembly of the enclosure;

means for releasably mounting the neck in place in the first opening;

a tether anchor releasably mounted in the second opening;

a tether extending between the bladder and the tether anchor and releasably mounted to the tether anchor to hold the bladder away from the first opening;

first cap means for releasably sealing the first opening and the neck; and second cap means for releasably sealing the second opening;

said bladder and first cap means forming a first sealed system, and said enclosure and first and second cap means forming a second sealed system effective to prevent spillage in the event of a failure of the bladder.

14. The invention of claim 13 wherein the central cavity communicates with a region exterior the enclosure only via the first and second openings.

15. The invention of claim 14 wherein the enclosure defines first and second recesses positioned to receive the first and second cap means to prevent the first and second cap means from protruding from the enclosure.

16. The invention of claim 13 wherein the enclosure defines a raised handle on one end and a depression on the outer end shaped and positioned to receive a handle of a second, similarly shaped enclosure when stacked thereon.

17. The invention of claim 14 wherein the tether defines a hook, wherein the bladder defines a hook receiving ring, and wherein the tether is releasably secured to the bladder by the hook and the ring.

18. The invention of claim 14 wherein the tether defines an array of raised projections; wherein the tether anchor defines an opening having a larger portion sized to pass the tether including the projections, and a smaller portion sized to engage the projections; and wherein the tether is releasably mounted to the tether anchor by the smaller portion of the opening and one of the raised projections.

19. The invention of claim 14 wherein the tether anchor is annular in shape and threadedly mounted to the enclosure in the second opening.

20. The invention of claim 13 wherein the neck defines a neck flange, and wherein the neck mounting means comprises:

a sleeve which defines a sleeve flange and a tube, said tube sized to fit within the neck to bring the sleeve flange adjacent to the neck flange; and a threaded annulus removably mounted on the enclosure around the first opening to releasably clamp the sleeve flange against the neck flange.

21. The invention of claim 20 wherein the first cap means comprises a threaded cap removably mounted to the threaded annulus around the first opening to releasably seal the first opening and the neck.

22. A method of using a double sealed container to control exposure to a material to be stored within the container comprising the following steps:

(a) providing a substantially rigid enclosure that defines a central cavity and a set of openings including at least a first opening extending between the central cavity and a region exterior of the enclosure, said central cavity communicating with the region exterior of the enclosure only via the set of openings;

(b) providing a bladder having a neck, said bladder defining an interior that communicates with the region exterior of the enclosure only via the neck, said bladder configured to be installed into and removed from the central cavity via an opening included in the set of openings;

(c) inserting said bladder into the cavity via one of the openings;

(d) mounting a tether anchor within said central cavity at a point spaced apart from the first opening;

(e) extending a tether between said bladder and the tether anchor and mounting the tether to the tether anchor to hold the bladder away from the first opening;

(f) releasably mounting the bladder neck in place in the first opening;

(g) introducing material into the bladder through the first opening into the neck of the bladder;

(h) mounting a bladder cap to releasably seal the first opening and the bladder neck to form a first sealed system with said bladder; and (i) securing a first enclosure cap over the bladder cap on said enclosure to form a second sealed system effective to prevent spillage of the material in the event of a failure of said bladder or bladder cap.

23. The invention of claim 21 wherein step (h) additionally comprises providing a frangible membrane in the bladder cap for forming the first sealed system.

24. The invention of claim 23 further comprising the following additional steps for removing the material in the container:

(j) removing said first enclosure cap from the first opening to expose the frangible membrane in said bladder cap;

(k) attaching a pour and purge device having a membrane puncture blade to puncture said bladder cap membrane, said device having an attachment to said bladder cap and a purge connection which is controlled by at least one valve; and (l) removing the material within the bladder through said purge device.

25. A container housing comprising:

a substantially rigid enclosure that defines a central cavity and a set of openings including at least a first opening extending between the central cavity and a region exterior of the enclosure, said central cavity communicating with the region exterior of the enclosure only via the set of openings;

said enclosure having substantially planar surfaces along the top and bottom surfaces, one of said top and bottom surfaces defining protrusions and the other of said top and bottom surfaces having recesses shaped to receive said protrusions of a second, similar enclosure to brace the enclosures when stacked together; and means formed on said enclosure adjacent to said first opening to engage a closure device to seal said first opening.

26. The invention of claim 25 wherein said set of openings additionally comprises a second opening, and wherein the central cavity communicates with the region exterior of the cavity only via the first and second openings.

27. The invention of claim 25 wherein said cavity defines an ovoid surface.

28. The invention of claim 26 wherein said first opening is recessed below the top surface and said second opening is recessed above the bottom surface.

29. The invention of claim 27 wherein the openings are each placed on a respective recessed surface formed at an angle acute to said top and bottom surfaces.

30. The invention of claim 28 wherein said enclosure has at least three substantially vertical side surfaces, each nearly adjacent to two other side surfaces.

31. The invention of claim 29 wherein said enclosure defines four side surfaces.

32. The invention of claim 31 wherein said top and bottom surfaces are substantially rectangular and said four side surfaces are nearly adjacent to said top and bottom surfaces.

33. The invention of claim 32 wherein the enclosure defines a raised handle on said top surface.

34. The invention of claim 33 wherein the enclosure defines a depression forming a pouring grip on said bottom surface and positioned to receive a handle of another similarly shaped enclosure when stacked thereon.

35. The invention of claim 34 further comprising first and second caps removably secured to the enclosure at the first and second openings to seal the first and second openings, respectively.

36. The invention of claim 35 wherein said first cap is further defined by a bladder cap forming a first seal on said first opening and a first enclosure cap forming a second seal on said first opening.

37. A bladder for insertion in a container having a substantially rigid enclosure that defines a central cavity and a set of openings including at least a first opening extending between the central cavity and a region exterior of the enclosure;

said bladder having a neck to store and discharge material only via the neck, said bladder constructed of a substance having a plasticity ranging from flexible to semi-rigid and resistant to toxic materials;

said neck having an end portion to allow sealed connection to said opening of the enclosure and receive an insert to provide sealable contact with an external member; and said bladder having a mechanical interlock positioned opposite the neck to allow a connection within the container cavity to prevent the bladder from collapsing and blocking exit of the material from the neck of the bladder when material is poured from said bladder.

38. The invention of claim 37 wherein the bladder is of an ovoid shape having the neck protruding along the major axis of the bladder.

39. The invention of claim 37 wherein said mechanical interlock comprises a protrusion having an opening suitable for tether attachment.

40. The invention of claim 37 wherein said mechanical interlock comprises a tether attachment secured integrally with the bladder.

* * * * *

UNITED STATES PATENT AND TRADEMARK OFFICE

CERTIFICATE OF CORRECTION

PATENT NO. : 4,993,579

DATED : February 19, 1991

INVENTOR(S) : Dennis M. Burchett

It is certified that error appears in the above-identified patent and that said Letters Patent is hereby corrected as shown below:

IN THE ABSTRACT

On the cover page, line 9 of the Abstract, please delete "in" and substitute therefor --to--.

In column 1, line 7, before "toxic" please insert --container suitable for the storage and shipment of--.

In column 7, line 37, please delete "L".

Signed and Sealed this

Fourth Day of August, 1992

*Attest:*

DOUGLAS B. COMER

*Attesting Officer*

*Acting Commissioner of Patents and Trademarks*